US011250736B2

(12) United States Patent
Huang et al.

(10) Patent No.: US 11,250,736 B2
(45) Date of Patent: Feb. 15, 2022

(54) DISPLAY PANEL AND FLEXIBLE DISPLAY DEVICE

(71) Applicants: Chengdu BOE Optoelectronics Technology Co., Ltd., Chengdu (CN); BOE Technology Group Co., Ltd., Beijing (CN)

(72) Inventors: Peng Huang, Beijing (CN); Zhifeng Zhan, Beijing (CN); Shuquan Yang, Beijing (CN); Yanxin Wang, Beijing (CN); Jiafan Shi, Beijing (CN); Wei Wang, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 199 days.

(21) Appl. No.: 16/617,132

(22) PCT Filed: May 8, 2019

(86) PCT No.: PCT/CN2019/086070
§ 371 (c)(1),
(2) Date: Nov. 26, 2019

(87) PCT Pub. No.: WO2019/228160
PCT Pub. Date: Dec. 5, 2019

(65) Prior Publication Data

US 2021/0027665 A1 Jan. 28, 2021

(30) Foreign Application Priority Data

May 31, 2018 (CN) ..... 201810552266.5

(51) Int. Cl.
*G09F 9/30* (2006.01)

(52) U.S. Cl.
CPC ..... *G09F 9/301* (2013.01)

(58) Field of Classification Search
None
See application file for complete search history.

(56) References Cited

U.S. PATENT DOCUMENTS 9,276,055 B1 * 3/2016 Son ..... H01L 51/0097
9,287,329 B1 * 3/2016 Lee ..... H01L 27/1218
(Continued)

FOREIGN PATENT DOCUMENTS

CN 105009188 A 10/2015
CN 105989783 A 10/2016
(Continued)

OTHER PUBLICATIONS

Office Action from corresponding Chinese Application No. 201810552266.5.

*Primary Examiner* — Xanthia C Cunningham
(74) *Attorney, Agent, or Firm* — Arent Fox LLP; Michael Fainberg

(57) ABSTRACT

The disclosure provides a display panel and a flexible display device. The display panel includes: a non-bending region, which includes a first non-bending region and a second non-bending region; a bending region, configured to connect with the first non-bending region and the second non-bending region; a supporting structure, between the first non-bending region and the second non-bending region and close to the bending region, where the supporting structure is configured to support the first non-bending region and the second non-bending region; and a buffer structure, on at least one edge of the supporting structure close to the bending region, and configured to buffer pressing of the edge of the supporting structure on the non-bending region.

13 Claims, 5 Drawing Sheets

(56) References Cited

U.S. PATENT DOCUMENTS

| | | | | |
|---|---|---|---|---|
| 2014/0217382 | A1* | 8/2014 | Kwon | H01L 51/5246 257/40 |
| 2015/0263300 | A1 | 9/2015 | Namkung et al. | |
| 2016/0275830 | A1 | 9/2016 | You et al. | |
| 2017/0047547 | A1 | 2/2017 | Son et al. | |
| 2017/0179423 | A1 | 6/2017 | Kwon et al. | |
| 2017/0263888 | A1* | 9/2017 | Choi | G02F 1/133305 |
| 2017/0271616 | A1 | 9/2017 | Choi et al. | |
| 2018/0019417 | A1* | 1/2018 | Andou | H05K 1/0269 |
| 2018/0027673 | A1* | 1/2018 | Andou | H01L 51/0097 361/749 |
| 2018/0062094 | A1 | 3/2018 | Kwon et al. | |
| 2018/0197935 | A1 | 7/2018 | Yuan et al. | |
| 2019/0088902 | A1 | 3/2019 | Wang et al. | |
| 2019/0139905 | A1 | 5/2019 | Cheng et al. | |

FOREIGN PATENT DOCUMENTS

| | | | | | |
|---|---|---|---|---|---|
| CN | 106887186 | A | | 6/2017 | |
| CN | 107221606 | A | | 9/2017 | |
| CN | 107565018 | A | | 1/2018 | |
| CN | 107864552 | A | | 3/2018 | |
| CN | 108054188 | A | | 5/2018 | |
| CN | 108054189 | A | | 5/2018 | |
| CN | 108735103 | A | | 11/2018 | |
| KR | 20180082717 | A | * | 7/2018 | H01L 51/529 |
| WO | 2014119972 | A1 | | 8/2014 | |

* cited by examiner

DISPLAY PANEL AND FLEXIBLE DISPLAY DEVICE

The present application is a US National Stage of International Application No. PCT/CN2019/086070, filed May 8, 2019, which claims priority to Chinese Patent Application. No. 201810552266.5, filed with the Chinese Patent Office on May 31, 2018, and entitled "Display Backplane", which is hereby incorporated by reference in its entirety.

FIELD

The present disclosure relates to the technical field of display, in particular to a display panel and a flexible display device.

BACKGROUND

Along with the progress of the display technology, the flexible display devices are getting more and more attention due to the advantages of low power consumption, small in size, deformable, bendable and the like. The development of a flexible anti-bending display product becomes the research emphasis in the display field, and especially the implementation of a narrow-bezel flexible organic light-emitting diode (OLED) display device is the research and development hot topic of the display field.

SUMMARY

The embodiment of the disclosure provides a display panel. The display panel includes: a non-bending region, including a first non-bending region and a second non-bending region; a bending region, configured to connect with the first non-bending region and the second non-bending region; a supporting structure, between the first non-bending region and the second non-bending region and close to the bending region, where the supporting structure is configured to support the first non-bending region and the second non-bending region; and a buffer structure, on at least one edge of the supporting structure close to the bending region and is configured to buffer pressing of the edge of the supporting structure on the non-bending region.

Optionally, in the embodiment of the present disclosure, two edges of the supporting structure close to the bending region are symmetrically provided with the buffer structures.

Optionally, in the embodiment of the present disclosure, the buffer structure includes a buffer adhesive layer; and Young's modulus of a material of the buffer adhesive layer is smaller than Young's modulus of a material of the supporting structure.

Optionally, in the embodiment of the present disclosure, the material of the buffer adhesive layer includes a plastic resin material.

Optionally, in the embodiment of the present disclosure, the buffer structure includes a slope structure on the edge of the supporting structure close to the bending region.

Optionally, in the embodiment of the present disclosure, the display panel further includes a bottom film between the non-bending region and the supporting structure; one side of the bottom film close to the bending region is provided with a bottom film gradual transition region, and the length of the slope structure is no smaller than the length of the bottom film gradual transition region along the arrangement direction of the first non-bending region and the bending region.

Optionally, in the embodiment of the present disclosure, the shape of the cross section of the slope structure along the arrangement direction of the first non-bending region and the bending region includes at least one of a slope shape, a circular arc shape, a step shape, a zigzag shape and a wave shape.

Optionally, in the embodiment of the present disclosure, the shape of the cross section of the slope structure is the circular arc shape, and the center of the circular arc is on one side of the supporting structure away from the bending region.

Optionally, in the embodiment of the present disclosure, the center of the circular arc is inside the supporting structure.

Optionally, in the embodiment of the present disclosure, the shape of the cross section of the slope structure is the circular arc shape, and the center of the circular arc is on one side of the supporting structure facing the bending region.

Optionally, in the embodiment of the present disclosure, the shape of the cross section of the slope structure is the step shape, and the number of steps is no smaller than 1.

Optionally, in the embodiment of the present disclosure, the display panel further includes a bonding layer between the supporting structure and the first non-bending region.

Optionally, in the embodiment of the present disclosure, the bonding layer includes a double-side tap.

The embodiment of the present disclosure also provides a flexible display device which includes the above display panel.

DETAILED DESCRIPTION

Figure 1:
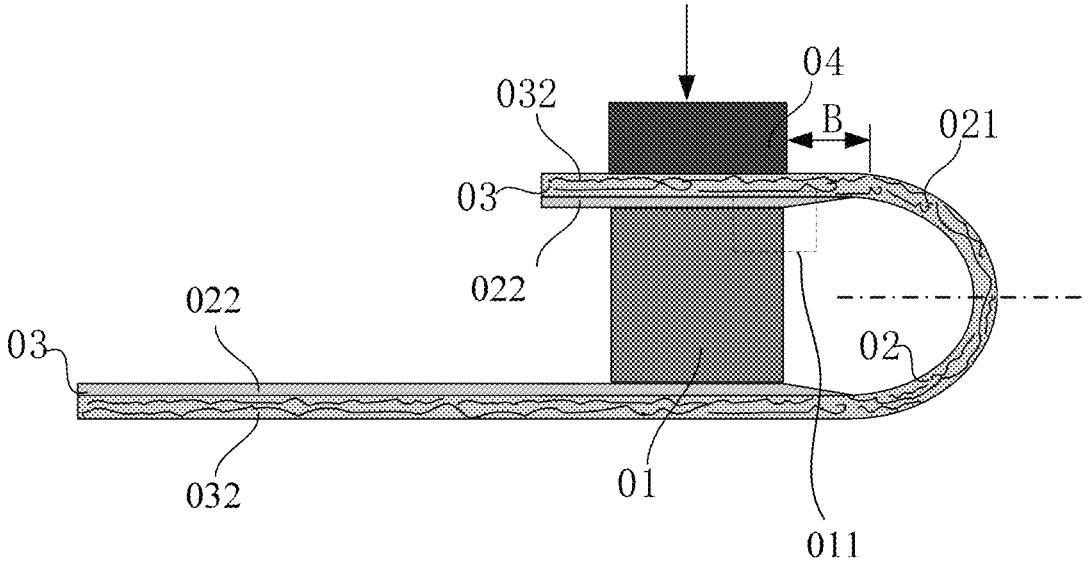
FIG. 1 is a schematic structural diagram of a display panel in the related art.

In order to make the objects, technical solutions, and advantages of the disclosure more apparent, the disclosure will be described below in further details with reference to the drawings. Apparently the embodiments to be described are only a part but not all of the embodiments of the disclosure. Based upon the embodiments here of the disclosure, all of other embodiments which can occur to those ordinarily skilled in the art without any inventive effort shall come into the claimed scope of the disclosure.

Unless otherwise defined, technical terms or scientific terms used by the present disclosure should be the ordinary meanings which can be understood by people with general skills in the field to which the present disclosure belongs. "First", "second" and similar words used in the present disclosure do not show any sequence, quantity or importance but are used for distinguishing different components. Similar words, including "comprise" or "include" and the like, mean that elements or objects in front of the words contain elements or objects and equivalence thereof listed behind the words without excluding other elements or objects. Similar words, including "connect" or "link" and the like, are not limited to physical or mechanical connection but can include electric connection, no matter direct connection or indirect connection.

It should be noted that the size and the shape of each component in the drawings do not reflect a true ratio but only intend to indicate the present disclosure. In addition, the same or similar numeral shows the same or similar element or the element with the same or similar function throughout the disclosure.

Figure 2:
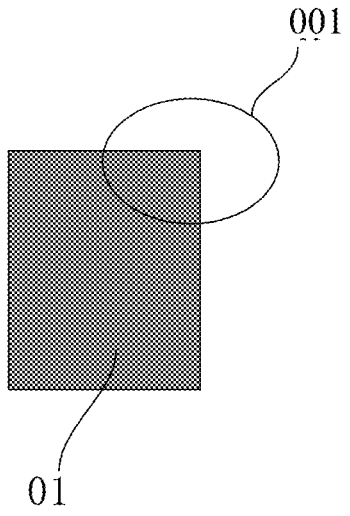
FIG. 2 is a schematic structural diagram of a supporting structure in the display panel in the related art.

Generally, when the bending region of the flexible display device is subjected to a bending technology, the bending resistance of the bending region is one important indicator of the flexible display device. As shown in FIG. 1 and FIG. 2, the display panel can include a supporting structure 01, a bending region 02 and a non-bending region 03. The supporting structure 01 is a foam adhesive layer (polyurethane foam adhesive) and is configured to support the non-bending region 03 of the bent display panel. The non-bending region 03 of the display panel is generally provided with one or more metal wires 021 (such as a data line in a source and drain electrode metal layer) and a bottom film 022 arranged between the non-bending region 03 and the supporting structure 01. Generally the process of the bending technology for forming the bending region 02 can include two steps: pre-bend and main-bend. When a main-bend pressure head 04 downwards moves, the non-bending region 03 is preferentially in contact with the edge 011 (such as a position 001 in FIG. 2) of the supporting structure 01 facing the bending region 02, and therefore the bottom film 022 is pressed. Therefore, the edge 001 of the supporting structure 01 has an obvious pressure function on the metal wire 021. Since the thickness of the bottom film 022 is smaller than 1/10 of the thickness of the supporting structure 01, a stress concentration region B is generated on the non-bending region 03 so as to cause a situation that the metal wire 021 is wrinkled or broken, thus resulting in the poor reliability the display panel and the device failure of the display panel, further resulting poor circuit contact of the display panel, and therefore affecting the bending success rate and the product yield of the flexible display device.

Therefore, the embodiment of the present disclosure provides some display panels which can lower a wrinkling or breaking risk of the metal wires of the bending region and improve the product reliability and the device stability of the display panel.

Some embodiments of the present disclosure provide a display panel. As shown in FIG. 3 to FIG. 9, the display panel can include a bending region 2, a non-bending region 3, a supporting structure 1 and a buffer structure 10. The non-bending region 3 includes a first non-bending region 31 and a second non-bending region 32, and the bending region 2 is configured to connect with the first non-bending region 31 and the second non-bending region 32. The supporting structure 1 is arranged between the first non-bending region 31 and the second non-bending region 32 and is close to the bending region 2, and the supporting structure 1 is configured to support the first non-bending region 31 and the second non-bending region 32. The buffer structure 10 is located on at least one edge of the supporting structure 1 close the bending region 2, and the buffer structure 10 is configured to buffer the pressing of the edge of the supporting structure 1 on the non-bending region 3.

In the display panel according to the embodiment of the disclosure, since the buffer structure 10 for buffering the bending stress of the bending region 2 is formed on the edge position of the supporting structure 1 close to the bending region 2, the bending region 2 generates a large stress during bending when the bending region 2 of the display panel is subjected to the bending technology and the large stress is conducted to the buffer structure 10. Due to the buffer function of the buffer structure 10, the edge of the supporting structure 1 can be prevented to press the bottom film 22 of the non-bending region 3 and the metal wire in the source and drain electrode metal layer of the non-bending region 3, so that the pressing of the edge of the supporting structure 1 on the metal wire during bending can be reduced, a risk that the metal wire 21 in the display panel is broken when the bending region 2 is bent can be reduced, the bending success rate of the display panel can be improved, and the volume production yield of the product is improved.

Generally the display panel includes a substrate, and a plurality of electroluminescence units and the metal wires are arranged on the substrate, wherein the electroluminescence unit can include an electroluminescence diode and a pixel circuit configured to drive the electroluminescence diode to emit light. The metal wire can be a data line for transmitting a data signal to the pixel circuit and/or a gate line for transmitting a scanning signal to the pixel circuit. Exemplarily, the substrate is a flexible substrate. In an specific implementation, in the embodiment of the present disclosure, as shown in FIG. 3 and FIG. 5 to FIG. 9, the display panel can further include a bottom film 22 located between the non-bending region 3 and the supporting structure 1. Exemplarily, the Young's modulus of the material of the bottom film 22 is smaller than the Young's modulus of the material of the supporting structure 1. In practical application, a pressure sensitive adhesive is further arranged between the bottom film 22 and the non-bending region 3. The above display panel manufacture technology refers to product thickness in the industry, and the total thickness of the bottom film 22 and the pressure sensitive adhesive is 0-30 μm, wherein the value of the total thickness of the bottom film 22 and the pressure sensitive adhesive can be determined according to requirements of the neutral layer of the metal wire layer in the bending region 2.

Exemplarily, the electroluminescence diode can be an OLED, so that an OLED display panel can be realized, or the electroluminescence diode can be a quantum dot light emitting diode (QLED), and therefore, a QLED display panel can be realized.

In a specific implementation, in the embodiment of the present disclosure, a buffer structure 10 can be arranged on one edge of the supporting structure 1 which is close to the second non-bending region 32 and close to the bending region 2. Alternatively the buffer structure 10 can be arranged on one edge of the supporting structure 1 which is close to the first non-bending region 31 and close to the bending region 2. Alternatively the buffer structure 10 can be arranged on one edge of the supporting structure 1 which is close to the second non-bending region 32 and close to the bending region 2, meanwhile, the buffer structure 10 can further be arranged on one edge of the supporting structure 1 which is close to the first non-bending region 31 and close to the bending region 2, and therefore, two edges of the supporting structure which is close to the bending region are both provided with the buffer structures. Exemplarily, two edges of the supporting structure which is close to the bending region are symmetrically provided with the buffer structures, i.e., the formed buffer structures are symmetric along the central axial line OO of the bending region 2. Therefore, both the first non-bending region 31 and the second non-bending region 32 can evenly alleviate the stress.

Figure 3:
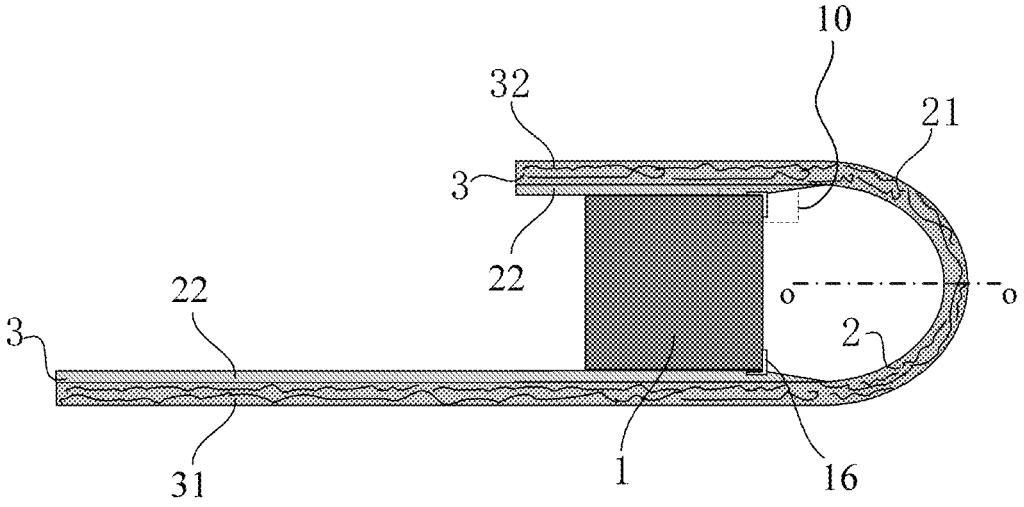
FIG. 3 is a first schematic structural diagram of a display panel according to the present disclosure.
Figure 4:
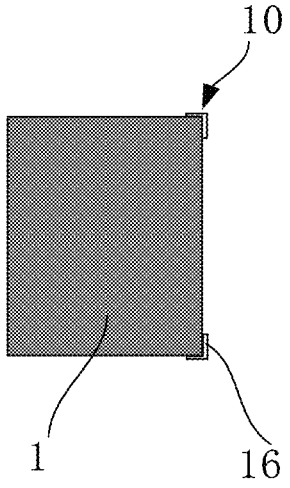
FIG. 4 is a schematic structural diagram of a supporting structure in the display panel shown in the FIG. 3.

In a specific implementation, in the embodiment of the present disclosure, as shown in FIG. 3 and FIG. 4, for example, the buffer structure 10 can include a buffer adhesive layer 16 arranged on the edge position of the supporting structure 1 close to the bending region 2. The Young's modulus of the material of the buffer adhesive layer is smaller than the Young's modulus of the material of the supporting structure. Exemplarily, two edge positions of the supporting structure 1 close to the bending region 2 are symmetrically provided with the buffer adhesive layers 16.

In the above display panel, when the bending region 2 of the display panel is subjected to the bending technology, the large stress generated during the bending of the bending region 2 can be conducted to the buffer adhesive layer 16 on the edge position of the supporting structure 1 close to the bending region 2, and the buffer adhesive layer 16 acts as a buffer function. On one hand, it can reduce the upward pressing effect of the supporting structure 1 on the metal wire during main-bending, so as to lower a risk that the metal wire of the bending region 2 is broken and improve product reliability and device stability. In addition, it can avoid the pressing of the edge of the supporting structure 1 on the bottom film 22 of the non-bending region 3 and the pressure sensitive adhesive, reduce the pressing of the edge of the supporting structure 1 on the metal wire in the bending region 2, so that a breaking risk of the internal metal wire 21 when the bending region 2 is bent can be reduced, the bending success rate of the display panel is improved, and the volume production yield of the product is improved. On the other hand, the buffer adhesive layer 16 can increase adhesion between the supporting structure 1 and the bottom film 22 of the non-bending region 3 to a certain degree, and especially, a foam peeling phenomenon can be avoided when the buffer adhesive layer 16 is in contact with one end on the non-bending region 3 connected with the bending region 2.

Generally the plastic resin material has the characteristics of being softened by heating and hardened by cooling, being good in toughness, high in damage tolerance, good in dielectric constant and good in recyclability and being recycled and reused without environment pollution, so that the plastic resin material is usually used as a buffer material and an environmental protection material. In a specific implementation, in the embodiment of the present disclosure, the material of the buffer adhesive layer can include the plastic resin material. Therefore, the buffer adhesive layer 16 is prepared from the plastic resin material. Certainly, in the above display panel, the buffer adhesive layer also can be prepared from other materials capable of realizing a buffer function, such as double-side tap and the like, which are not limited hereby.

In a specific implementation, in the embodiment of the present disclosure, as shown in FIG. 5, FIG. 6, FIG. 7, FIG. 8 and FIG. 9, for example, the buffer structure 10 also can include a slope structure located on the edge of the supporting structure 1 which is close to the bending region 2. In the above display panel, since the buffer structure 10 is the slope structure arranged on the edge position of the supporting structure 1 close to the bending region 2, thus one end of the non-bending region 3 connected with the bending region 2 is not in contact with the slope structure, and therefore the edge of the supporting structure 1 close to the bending region 2 is in less contact with the bottom film 22 on the non-bending region 3. When the bending region 2 of the display panel is subjected to the bending technology, the edge of the supporting structure 1 can be prevented to press the bottom film 22 of the non-bending region 3 and the metal wire 21 of the non-bending region 3, thus reducing the pressing of the edge of the supporting structure 1 on the metal wire 21 during bending, reducing the breaking of the internal metal wiring 21 when the bending region 2 is bent, improving the bending success rate of the display panel and the volume production yield of the product.

In a specific implementation, in the embodiment of the present disclosure, one side of the bottom film 22 close to the bending region 2 is provided with a bottom film gradual transition region, and the length $L_1$ of the slope structure is no smaller than the length $L_2$ of the bottom film gradual transition region along the arrangement direction of the first non-bending region 21 and the bending region 2. In the above display panel, the length $L_1$ of the slope structure can be equal to the length $L_2$ of the bottom film gradual transition region, and the length $L_1$ of the slope structure can also be greater than the length $L_2$ of the bottom film gradual transition region. The length $L_1$ of the slope structure is limited to be no smaller than the length $L_2$ of the bottom film gradual transition region, so that the contact of the edge of the supporting structure 1 close to the bending region 2 and the bottom film gradual transition region on the non-bending region 3 can be reduced as far as possible on the basis of guaranteeing that a supporting and bonding function is realized by the supporting structure 1. Therefore, when the bending region 2 of the display panel is subjected to the bending technology, the edge of the supporting structure 1 can be prevented to press the bottom film 22 of the non-bending region 3 and the metal wire 21 of the non-bending region 3, thus reducing the pressing of the edge of the supporting structure 1 on the metal wire 21 in the bending region 2 during bending when the bending region 2 is bent, improving the bending success rate of the display panel, and the volume production yield of the product.

In a specific implementation, in the embodiment of the present disclosure, as shown in FIG. 5, FIG. 6, FIG. 7, FIG. 8 and FIG. 9, for example, two edge positions of the supporting structure 1 close to the bending region 2 are symmetrically provided with the slope structures. In the above display panel, the two edge positions of the supporting structure 1 close to the bending region 2 are set to be symmetrically provided with the slope structures, i.e., the formed slope structures are symmetric along the central axis line OO of the bending region 2, symmetric bending can be easily realized when the bending region 2 is bent while the bending region 2 of the display panel is subjected to the bending technology, and a bending operation can be conveniently realized, and the bending success rate of the display panel is improved.

In a specific implementation, in the embodiment of the present disclosure, along the arrangement direction of the first non-bending region and the bending region, the shape of the cross section of the slope structure includes at least one of a slope shape, a circular arc shape, a step shape, a zigzag shape and a wave shape. Certainly, in practical application, the shape of the cross section of the slope structure also can be other shapes symmetric along the central axis line of the bending region 2, and the specific shape of the cross section of the buffer structure 10 can be selected according to the practical situation of the display panel, which is not limited hereby.

Figure 6:
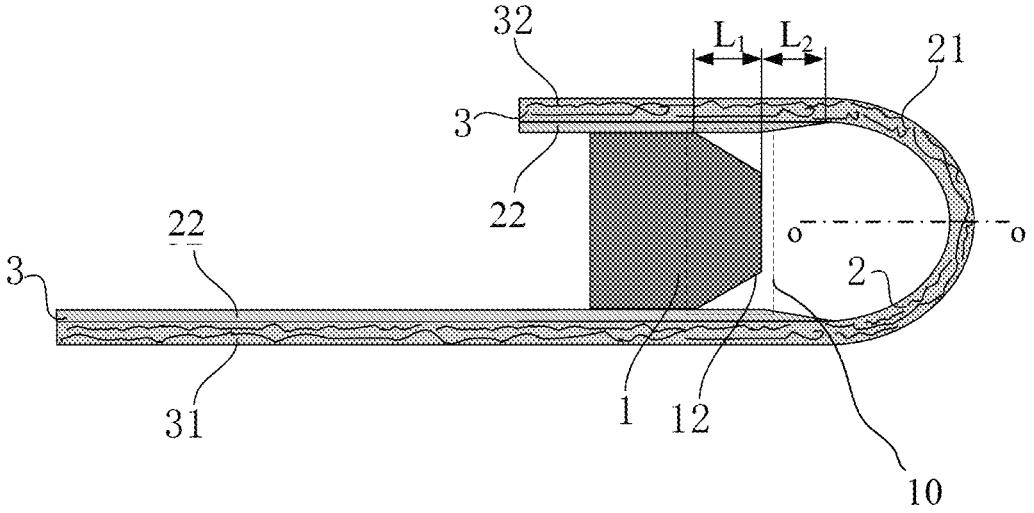
FIG. 6 is a third schematic structural diagram of a display panel according to the present disclosure.

Exemplarily, in a specific implementation, in the embodiment of the present disclosure, as shown in FIG. 6, along the arrangement direction of the first non-bending region 31 and the bending region 2, the shape of the cross section of the slope structure can be the slope shape 12. Therefore, when the bending region 2 of the display panel is subjected to the bending technology, on one hand, one end of the non-bending region 3 connected with the bending region 2 is not in contact with the slope structure with the slope shape 12 so as to prevent the edge of the supporting structure 1 to press the back membrane 22 and the metal wire 21 of the non-bending region 3. On the other hand, the bending region 2 generates the large stress during bending, the large stress is conducted to the part of the slope shape 12 in the supporting structure 1 to buffer bending stress, so that the breaking of the internal metal wire 21 when the bending region 2 is bent can be reduced, the bending success rate of the display panel is improved, and the volume production yield of the product is improved.

Figure 5:
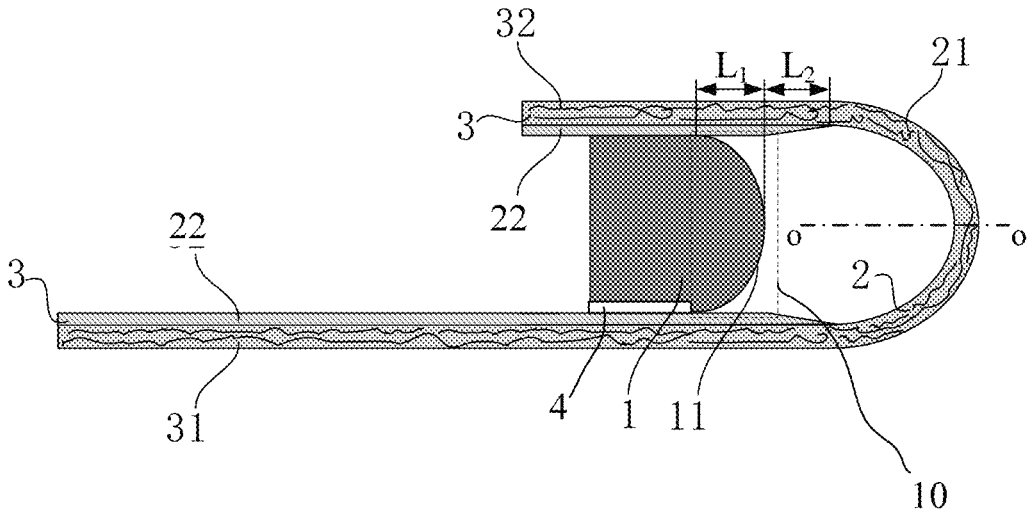
FIG. 5 is a second schematic structural diagram of a display panel according to the present disclosure.

Exemplarily, during a specific implementation, in the embodiment of the present disclosure, as shown in FIG. 5, the shape of the cross section of the slope structure can be the circular arc shape 11. The center of the circular arc can be located on one side of the supporting structure 1 away from the bending region 2. For example, the center of the circular arc can be located inside the supporting structure 1. Certainly, the center of the circular arc also can be positioned outside the supporting structure, which is not limited herein. Therefore, when the bending region 2 of the display panel is subjected to the bending technology, on one hand, one end of the non-bending region 3 connected with the bending region 2 is not in contact with the slope structure with the circular arc shape 11 so as to prevent the edge of the supporting structure 1 to press the bottom film 22 and the metal wire 21 of the non-bending region 3. On the other hand, when the bending region 2 is bent, large stress is generated and conducted to the circular arc part arranged in the supporting structure 1 to act as a buffer function so as to reduce a situation that the internal metal wire 21 is broken when the bending region 2 is bent, the bending success rate of the display panel is improved, and the volume production yield of the product is improved.

Figure 7:
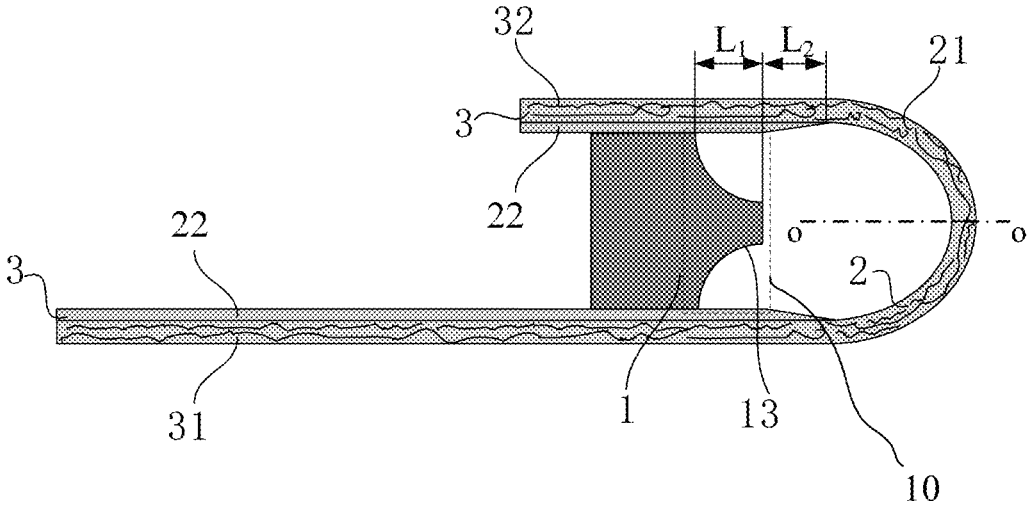
FIG. 7 is a fourth schematic structural diagram of a display panel according to the present disclosure.

Exemplarily, in a specific implementation, in the embodiment of the present disclosure, as shown in FIG. 7, the shape of the cross section of the slope structure can be the circular arc shape 13. The center of the circular arc can be located on one side of the supporting structure 1 facing the bending region 2. For example, the center of the circular arc can be located on a position which is outside the supporting structure 1 and faces the bending region 2. Therefore, when the bending region 2 of the display panel is subjected to the bending technology, on one hand, one end of the non-bending region 3 connected with the bending region 2 is not in contact with the slope structure with the circular arc shape 13 so as to prevent the edge of the supporting structure 1 to press the bottom film 22 and the metal wire 21 of the non-bending region 3. On the other hand, when the bending region 2 is bent, the generated large stress is conducted to a part of the supporting structure 1 away from the circular arc to buffer bending stress, so that a situation that the internal metal wire 21 is broken when the bending region 2 is bent can be reduced, the bending success rate of the display panel is improved, and the volume production yield of the product is improved.

Figure 8:
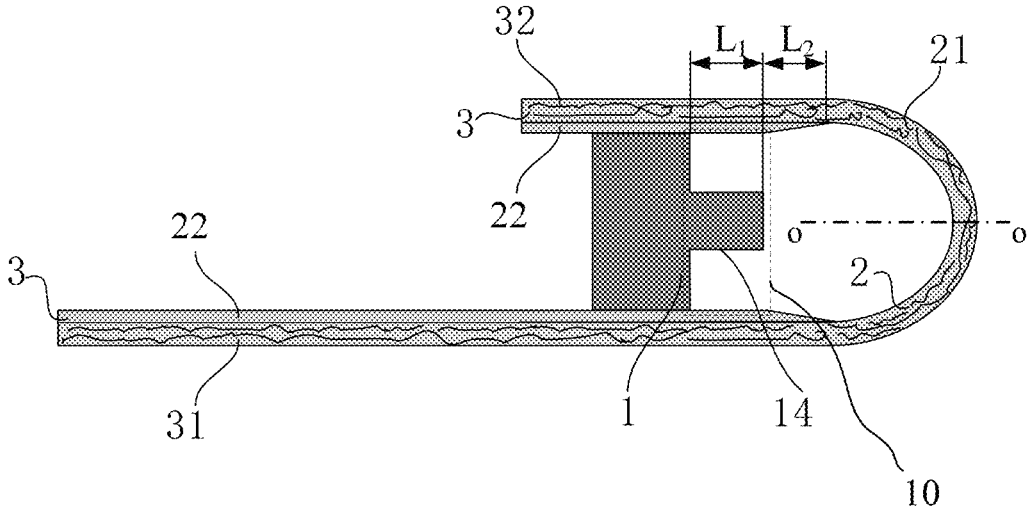
FIG. 8 is a fifth schematic structural diagram of a display panel according to the present disclosure.

Exemplarily, in a specific implementation, in the embodiment of the present disclosure, as shown in FIG. 8, the shape of the cross section of the slope structure can be the step shape 14, and the number of steps is N, N≥1. Therefore, when the bending region 2 of the display panel is subjected to the bending technology, on one hand, one end of the non-bending region 3 connected with the bending region 2 is not in contact with the slope structure of the step shape 14, so as to prevent the edge of the supporting structure 1 to press the bottom film 22 and the metal wire 21 of the non-bending region 3. On the other hand, when the bending region 2 is bent, the generated large stress is conducted to the part of the step shape 14 of the supporting structure 1 to buffer bending stress, so that a situation that the internal metal wire 21 is broken when the bending region 2 is bent can be reduced, the bending success rate of the display panel is improved, and the volume production yield of the product is improved.

Exemplarily, in a specific implementation, in the embodiment of the present disclosure, when the shape of the cross section of the slope structure is the step shape 14, the number of the steps can be one or more, a plurality of steps can buffer and offset the bending stress when the bending region 2 of the display panel is subjected to the bending technology, so as to reduce a situation that the internal metal wire 21 is broken when the bending region 2 is bent, the bending success rate of the display panel is improved, and the volume production yield of the product is improved.

Figure 9:
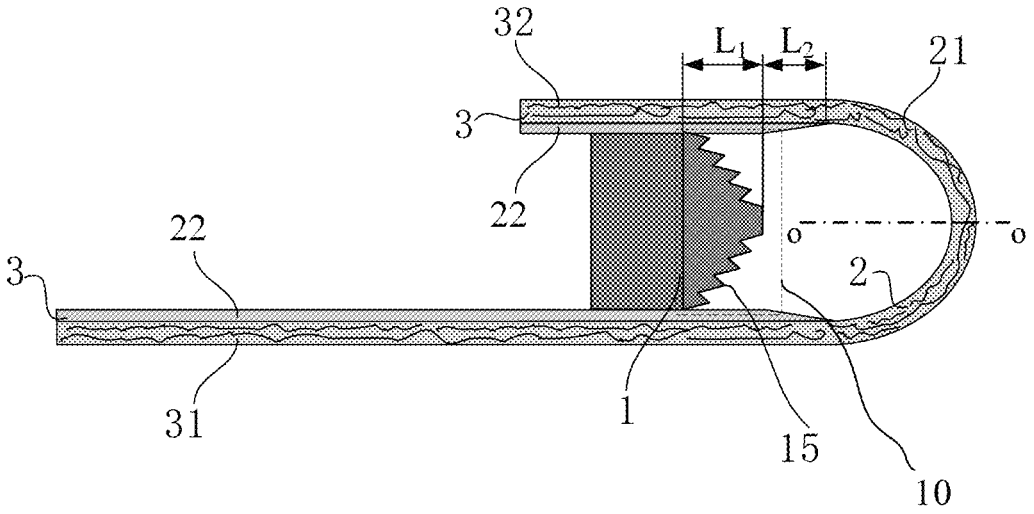
FIG. 9 is a sixth schematic structural diagram of a display panel according to the present disclosure.

Exemplarily, in a specific implementation, in the embodiment of the present disclosure, as shown in FIG. 9, the shape of the cross section of the slope structure can be the zigzag shape 15. Therefore, when the bending region 2 of the display panel is subjected to the bending technology, on one hand, one end of the non-bending region 3 connected with the bending region 2 is not in contact with the slope structure with the zigzag shape 15, so as to prevent the edge of the supporting structure 1 to press the metal wire 21. On the other hand, when the bending region 2 is bent, the generated large stress is conducted to the part of the zigzag shape 15 of the supporting structure 1 to buffer and offset the bending stress, so that a situation that the internal metal wire 21 is broken when the bending region 2 is bent can be reduced, the bending success rate of the display panel is improved, and the volume production yield of the product is improved.

Figure 10:
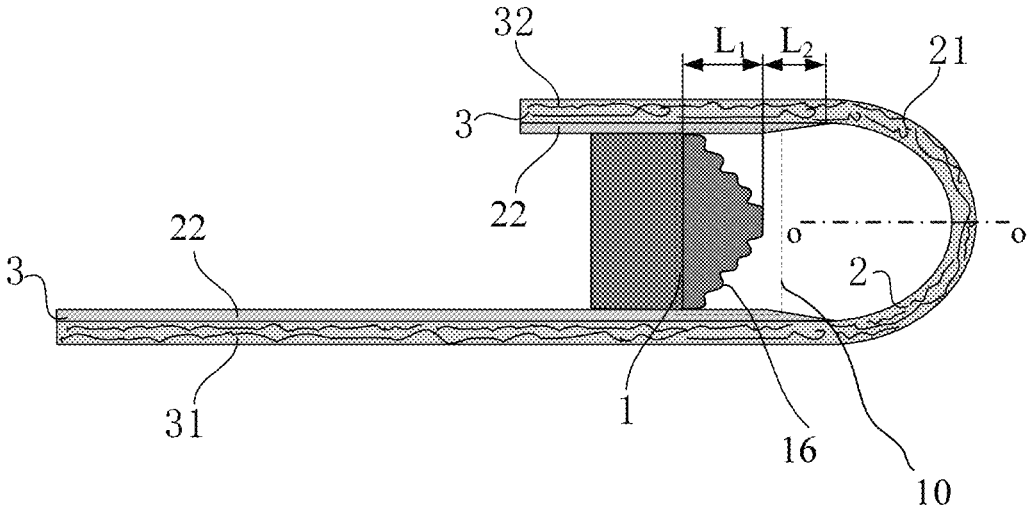
FIG. 10 is a seventh schematic structural diagram of a display panel according to the present disclosure.

Exemplarily, in a specific implementation, in the embodiment of the present disclosure, as shown in FIG. 10, the shape of the cross section of the slope structure can be the wave shape 16. Therefore, when the bending region 2 of the display panel is subjected to the bending technology, on one hand, one end of the non-bending region 3 connected with the bending region 2 is not in contact with the slope structure of the wave shape 16, so as to prevent the edge of the supporting structure 1 to press the metal wire 21. On the other hand, when the bending region 2 is bent, the generated large stress is conducted to the part of the wave shape 16 of the supporting structure 1 to buffer and offset the bending stress, so that a situation that the internal metal wire 21 is broken when the bending region 2 is bent can be reduced, the bending success rate of the display panel is improved, and the volume production yield of the product is improved.

Exemplarily, during specific implementation, in the embodiment of the present disclosure, the display panel can further include a bonding layer 4 between the supporting structure 1 and the first non-bending region 31. Exemplarily, the bonding layer can include a double-side tap. Therefore, the supporting structure 1 and the first non-bending region 31 can be more favorably fixed and bonded. Certainly, in the practical application, the material of the bonding layer 4 can be other materials which can meet a bonding effect, which is not limited herein. In addition, whether the slope structure is provided with the bonding layer 4 or not can be determined according to the practical requirements of the display panel and the supporting structure 1.

On the basis of the same inventive concept, the embodiment of the present disclosure also provides a flexible display device which includes the above display panel according to the embodiment of the present disclosure. The implementation of the flexible display device can refer to the embodiment of the above display panel, and repetitions are not given unnecessary details.

In a specific implementation, the display device according to the embodiment of the present disclosure can be products or parts with a display function, such as a mobile phone, a tablet computer, a television, a display, a laptop, a digital photo frame, a navigator and the like. Other indispensable components of the display device are all understood by those skilled in the art, and are not described herein and should not be construed as limiting the present disclosure.

In the display panel and the flexible display device according to the embodiment of the disclosure, since the buffer structure configured to buffer the bending stress of the bending region is formed at the edge position of the supporting structure close to the bending region, when the bending region of the display panel is subjected to the bending technology, the generated large stress is conducted to the buffer structure, due to the buffer function of the buffer structure, the edge of the supporting structure can be prevented to press the bottom film of the non-bending region and the metal wire in the source and drain electrode metal layer of the non-bending region, so that the pressure of the edge of the supporting structure on the metal wire during bending can be reduced, the risk that the metal wire in the display panel is broken when the bending region is bent can be reduced, the bending success rate of the display panel can be improved, and the volume production yield of the product is improved.

Although the preferred embodiments of the present disclosure are described, those skilled in the art can make additional modifications and variations for the embodiments once they know the basic concept. Therefore, the attached claims aim to be interpreted to include the preferred embodiments and all modifications and variations which fall into the range of the present disclosure.

Obviously, those skilled in the art can make various modifications and variations to the present disclosure without departing from the spirit and scope of the present disclosure. Thus the disclosure is also intended to encompass these modifications and variations thereto so long as the modifications and variations fall into the scope of the claims appended to the disclosure and their equivalents.

The invention claimed is:

1. A display panel, comprising:

a non-bending region, comprising a first non-bending region and a second non-bending region;

a bending region, configured to connect with the first non-bending region and the second non-bending region;

a supporting structure, between the first non-bending region and the second non-bending region and close to the bending region, wherein the supporting structure is configured to support the first non-bending region and the second non-bending region; and a buffer structure, on at least one edge of the supporting structure close to the bending region, and configured to buffer pressing of the edge of the supporting structure on the non-bending region;

wherein the buffer structure comprises a slope structure on the edge of the supporting structure close to the bending region.

2. The display panel according to claim 1, wherein two edges of the supporting structure close to the bending region are symmetrically provided with the buffer structures.

3. The display panel according to claim 1, wherein the buffer structure comprises a buffer adhesive layer; and Young's modulus of a material of the buffer adhesive layer is smaller than Young's modulus of a material of the supporting structure.

4. The display panel according to claim 3, wherein the material of the buffer adhesive layer comprises a plastic resin material.

5. The display panel according to claim 1, further comprising: a bottom film between the non-bending region and the supporting structure; wherein one side of the bottom film close to the bending region is provided with a bottom film gradual transition region, and a length of the slope structure is no smaller than a length of the bottom film gradual transition region along an arrangement direction of the first non-bending region and the bending region.

6. The display panel according to claim 1, wherein a shape of a cross section of the slope structure along an arrangement direction of the first non-bending region and the bending region comprises at least one of a slope shape, a circular arc shape, a step shape, a zigzag shape and a wave shape.

7. The display panel according to claim 6, wherein the shape of the cross section of the slope structure is the circular arc shape, and a center of the circular arc is on one side of the supporting structure away from the bending region.

8. The display panel according to claim 7, wherein the center of the circular arc is inside the supporting structure.

9. The display panel according to claim 6, wherein the shape of the cross section of the slope structure is the circular arc shape, and a center of the circular arc is on one side of the supporting structure facing the bending region.

10. The display panel according to claim 6, wherein the shape of the cross section of the slope structure is the step shape, and the number of steps is no smaller than 1.

11. The display panel according to claim 1, further comprising: a bonding layer between the supporting structure and the first non-bending region.

12. The display panel according to claim 11, wherein the bonding layer comprises double-sided tape.

13. A flexible display device, comprising the display panel according to claim 1.

* * * * *